US007255316B1

(12) United States Patent
Popadics

(10) Patent No.: US 7,255,316 B1
(45) Date of Patent: Aug. 14, 2007

(54) SUPPORT DEVICE FOR CANTILEVER TOILET BOWL

(76) Inventor: Timothy J. Popadics, 223 Wade Dr., Calhoun, GA (US) 30701

( * ) Notice: Subject to any disclaimer, the term of this patent is extended or adjusted under 35 U.S.C. 154(b) by 293 days.

(21) Appl. No.: 10/992,058

(22) Filed: Nov. 18, 2004

(51) Int. Cl.
*A47G 29/00* (2006.01)

(52) U.S. Cl. ..... 248/346.05; 4/252.1; 4/252.2

(58) Field of Classification Search ..... 4/252.1, 4/252.2; 248/346.01, 346.05, 346.06, 346.07, 248/357, 354
See application file for complete search history.

(56) References Cited

U.S. PATENT DOCUMENTS 6,595,480 B1 * 7/2003 Orlick ..... 248/346.01
6,805,327 B1 * 10/2004 Shen ..... 248/346.07
2005/0268390 A1 * 12/2005 Wright ..... 4/252.1

OTHER PUBLICATIONS www.dbindustriesllc.com, Bariatric Toilet Seat Support, 1926 County J, Little Suamico, WI 54141, Home page, Products, About Us, Installation Instructions, Installation Diagram, Physics Of The Toilet Displacement, ADA Version, Standard Version, White Version (2004).

* cited by examiner

*Primary Examiner*—Ramon O Ramirez
(74) *Attorney, Agent, or Firm*—Baker, Donelson, Bearman, Caldwell & Berkowitz PC

(57) ABSTRACT

A support device selectively disposed between a floor surface and a lower surface of distal end of a cantilever toilet in which a base defines a surface oriented at an oblique angle relative to a horizontal plane and with a guide rail attached to an upper portion of the base substantially parallel to the upper surface. A traveler operatively engaged to the guide member moves on the upper surface for selective positioning to bear against a lower surface of a cantilever toilet. A method of supporting a cantilever toilet is disclosed.

20 Claims, 4 Drawing Sheets

SUPPORT DEVICE FOR CANTILEVER TOILET BOWL

TECHNICAL FIELD

The present invention relates to supports for cantilever toilet bowls. More particularly, the present invention relates to apparatus and methods for selectively supporting cantilever mounted toilet bowls during high mass load usage.

BACKGROUND OF THE INVENTION

Recent years have seen increasing numbers of bariatric patients who suffer from obesity or weight significantly in excess of typical weights for individuals. For example, persons having a body mass index of 40 or greater (or often more than one hundred pounds over conventionally recommended body weight), may be considered morbidly obese. Special surgeries are available for such individuals, and hospitals handling this medical condition typically have facilities equipped for providing physical support and assistance to such individuals for accomplishing typical and ordinary physical functions. Additional supports are needed because the increased mass imposes higher than normal loadings on commonly used devices such as toilet bowls, chairs, beds, and the like.

Additional supports are particularly needed to assist the bariatric patient with using bathroom devices such as toilet bowls. Many facilities use cantilever mounted toilet bowls, whereby one end of the toilet bowl connects to a support in the wall. Cantilever toilets facilitate cleaning and mopping of the floor. The other support devices include rails mounted above the toilet bowl to facilitate grasping by the bariatric patient in order to assist use of the toilet bowl. However, such entrance and egress supports do not provide support to the cantilever toilet bowl, and the full weight of the bariatric patient on the toilet bowl can lead to failure and collapse of the toilet bowl.

While facilities especially designed for treating bariatric patients include floor-supported toilets, medical facilities are finding an increasing number of bariatric patients admitted for other reasons. Typical hospital rooms are configured for bathroom devices supporting patients of average weights, and particularly cantilever toilet bowls. Yet these fail to adequately provide reliable support to a heavily loaded toilet bowl, such as may be necessary for a bariatric patient.

Accordingly, there is a need in the art for a device for selectively and conveniently providing support to cantilever toilet bowls that are subject periodically to high mass loading. It is to such that the present invention is directed.

BRIEF SUMMARY OF THE INVENTION

The present invention meets the need in the industry by providing a support for being disposed between a floor surface and a lower surface of a distal end of a cantilever toilet attached at one end to a wall and extending therefrom, in which a base defines a surface oriented at an oblique angle relative to a horizontal plane and with a guide rail attached to an upper portion of the base member substantially parallel to the upper surface. A traveler operatively engaged to the guide member is movable on the upper surface for selective positioning to bear against a lower surface of a cantilever toilet for support thereof during use of the toilet.

Features, objects, and advantages of the present invention will be apparent upon reading the following detailed description in conjunction with the claims and the appended drawings.

DETAILED DESCRIPTION

Figure 1:
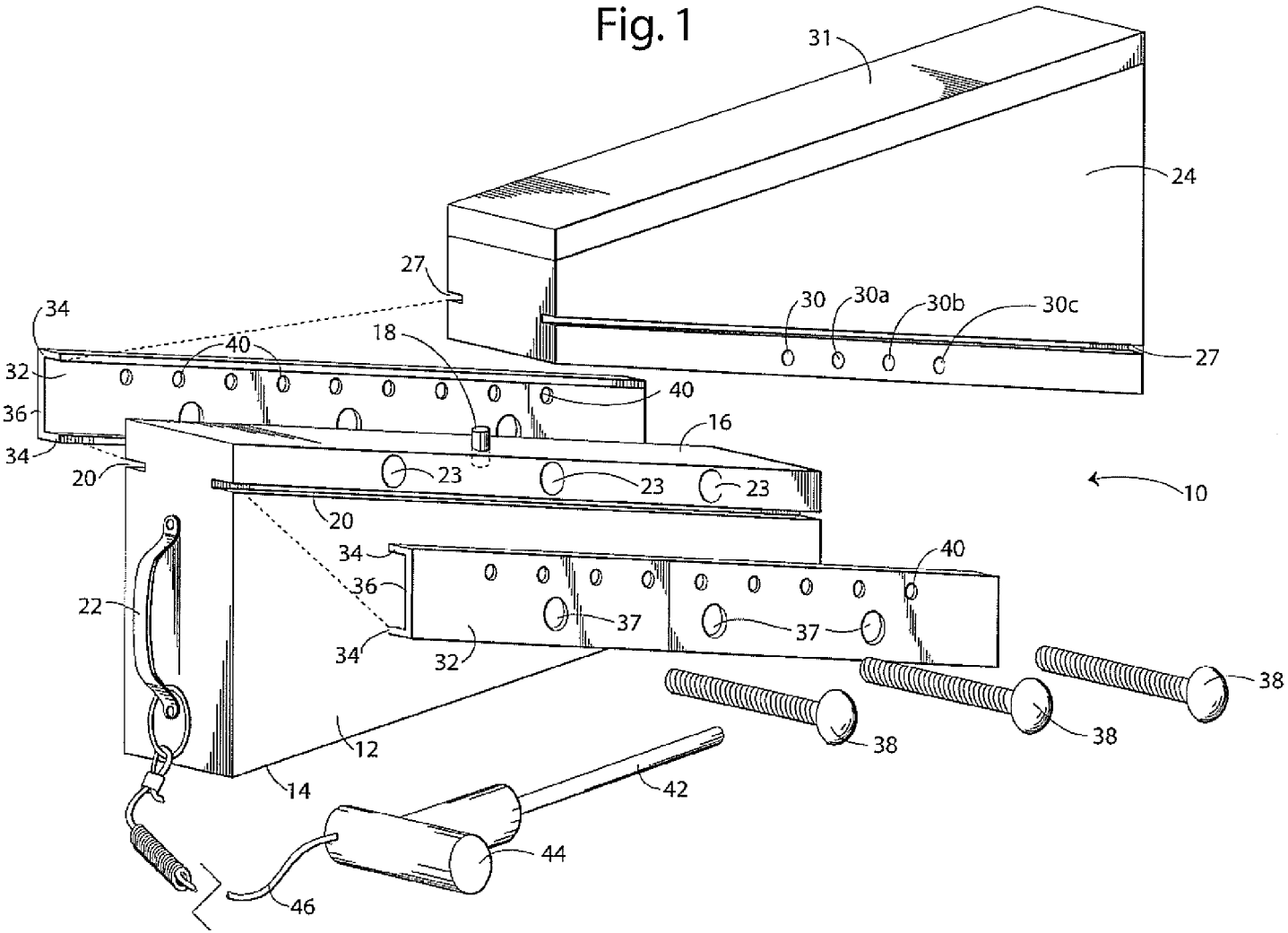
FIG. 1 is an exploded pictorial view of a toilet support device according to the present invention.

Referring now in more detail to the drawings, in which like numerals indicate like parts throughout the several views, FIG. 1 illustrates in exploded perspective view a toilet support device 10 according to the present invention. The support device 10 includes a base 12 having a bottom surface 14 that seats on a floor. An opposing traveler surface 16 is oriented at an oblique angle relative to a horizontal plane such as the floor on which the base rests. A pin 18 extends upwardly from the traveler surface 16 generally medial the opposing lateral sides and opposing distal ends, for a purpose discussed below. A pair of elongate slots 20 are defined in opposing sides of the base 12. The slots 20 are parallel to the traveler surface 16 and spaced therefrom. A handle 22 attaches to a front face of the base 12 for convenience in carrying and positioning the support device 10 for use. The base 12 defines spaced-apart transverse through openings 23 between the slot 20 and the traveler surface 16.

A traveler 24 seats on the traveler surface 16 for longitudinal movement of the traveler relative to the traveler surface 16 of the base 12. The traveler 24 includes a traveler surface 26 oriented at an oblique angle to horizontal for conforming contact with the traveler surface 16 of the base 12. The traveler surface 26 in an alternate embodiment can also have a slight oblique angle laterally. The traveler 24 defines opposing slots 27 spaced apart from the traveler surface 26 and parallel to the longitudinal angled orientation of the traveler surface 26. A positioning hole 30 extends transverse through the traveler 24 between the slots 27 and the traveler surface 26. In the illustrated embodiment, four positioning holes 30 are provided in spaced apart relation. While the positioning holes 30 may be equally spaced, in the illustrated embodiment, the spacing is non-uniform. Positioning holes 30 and 30*a* are spaced 1.5 inches apart, positioning holes 30*a* and 30*b* are spaced 1.25 inches apart; and positioning holes 30*b* and 30*c* are spaced 0.75 inches apart. The non-uniform spacing facilitates selective positioning of the traveler 24 relative to the base 12 as discussed below. A resilient pad 31 attaches such as with adhesive to an opposing surface of the traveler 24. The pad 31 provides a bearing surface to contact a lower surface of a cantilever toilet bowl.

A pair of opposing guiderails 32 interconnect the base 12 and the traveler 24. The guiderails 32 define a U-shaped channel in cross-sectional view having a pair of opposing legs 34 and a transverse bridge 36 between the legs. The bridge 36 defines openings 37 that align with the openings 23 in the base 12. The legs 34 are received in the respective slots 20, 27 on opposing sides of the support device 10. Fasteners 38 extend through the openings 23 in the base 12 and the aligned openings 37 in the guiderails 32 to secure the guiderails to the base. The traveler 24 seats for longitudinal movement on the traveler surface 16 of the base 12. The guiderails 32 hold the base 12 and the traveler 24 together.

The guiderail 32 further defines a plurality of spaced apart openings 40. The openings 40 are positioned to align selectively with one of the openings 30. In the illustrated embodiment, the openings 40 are 9/32 inches in diameter and are spaced apart on one inch centers. Other spacings for the openings 40 and 30 are readily used. The position holes 30 selectively align with one of the openings 40 in the guiderail 32 as the traveler 24 is selectively moved relative to the base 12. A pin 42 connects to a handle 44 and extends through one of the openings 40 and one of the aligned openings 30 in order to secure the traveler 24 in a selected position. A connector 46 extends between the handle 44 and the handle 22.

Figure 2:
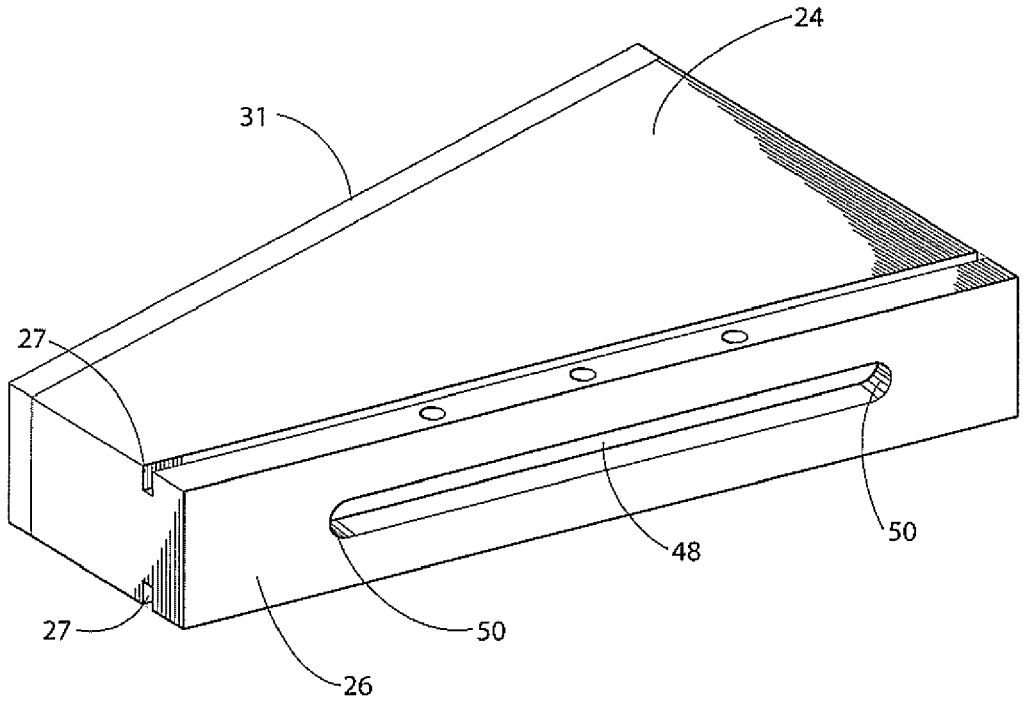
FIG. 2 is a perspective view illustrating features of a bottom of a traveler used with the toilet support device illustrated in FIG. 1.

With reference to FIG. 2, the traveler surface 26 of the traveler 24 defines an elongate slot 48 having opposing distal ends 50. The pin 18 extends from the traveler surface 16 into the slot 48 when the traveler 24 seats on the base 12. The distal ends 50 act as stops when the traveler 24 moves longitudinally relative to the base 12.

Figure 3:
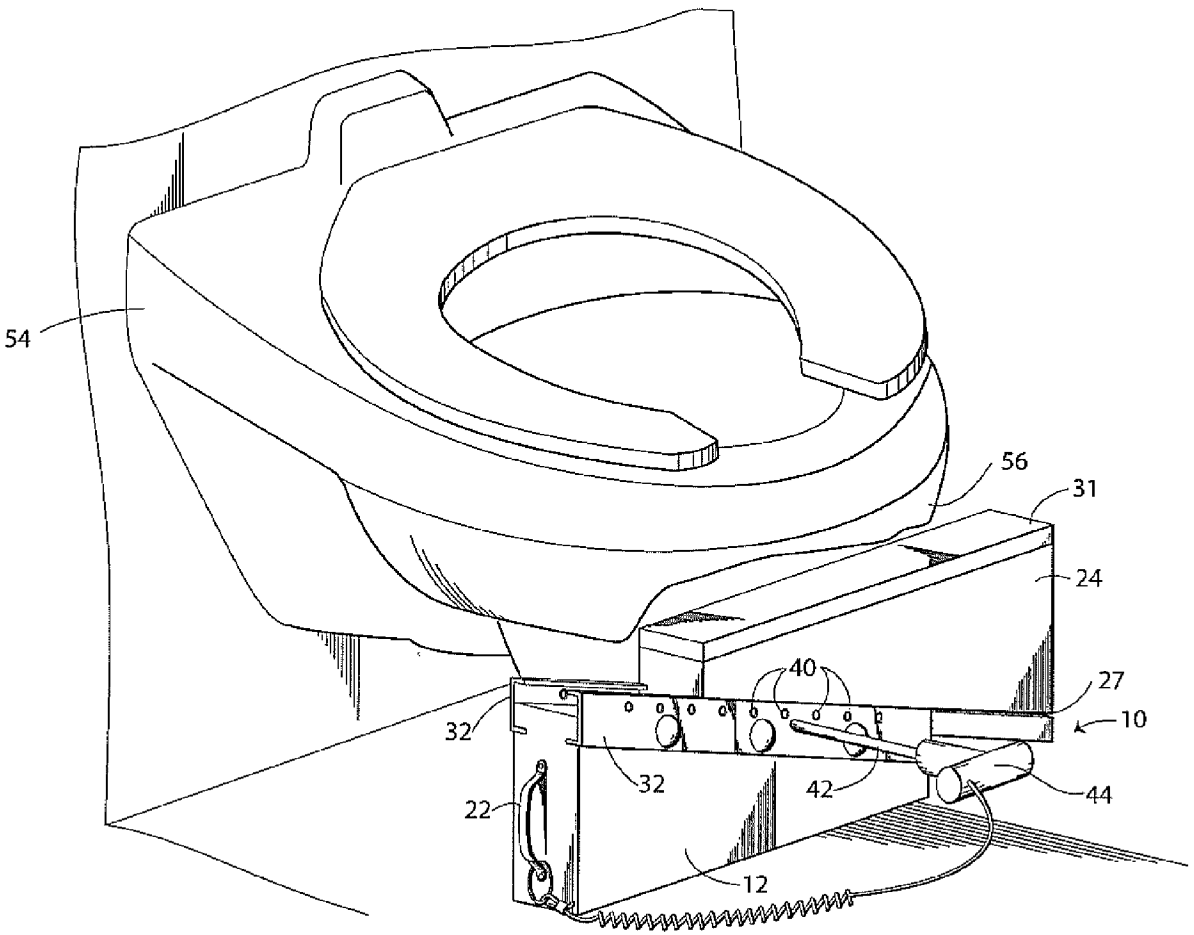
FIG. 3 is a perspective broken-away view of the toilet support device illustrated in FIG. 1 in use for supporting a cantilever toilet bowl.
Figure 4:
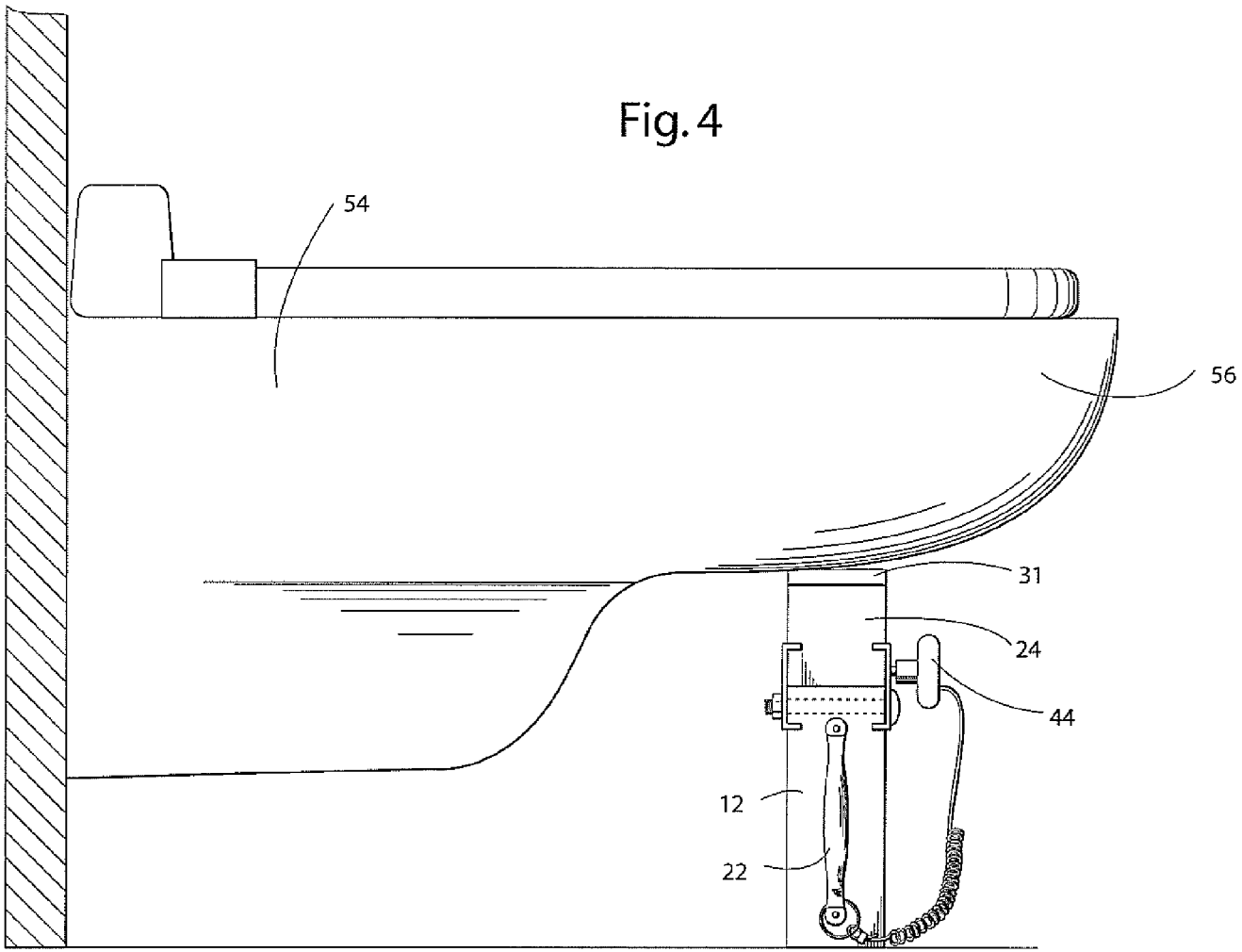
FIG. 4 is a side elevational view of the toilet bowl support installed under a distal edge of a cantilever toilet bowl in accordance with the present invention.

FIG. 3 illustrates in perspective broken-away view a cantilever toilet bowl 54 attached conventionally to supports in a wall with a distal end 56 supported by the toilet bowl support 10. FIG. 4 is a side elevational view of the toilet bowl support 10 installed under an edge portion of the distal end 56 of the cantilever toilet bowl 54 in accordance with the present invention. The handle 22 facilitates carrying the support 10 to the room for installation as well as positioning the base 12 beneath the toilet bowl 54.

The base 12 seats with the bottom surface 14 on the floor below an edge of the distal portion 56 of the toilet bowl 54. The pin 42 is removed from the guiderail 32 releasing the traveler 24 for longitudinal movement relative to the base 12. The traveler 24 is moved longitudinally to position the resilient pad 31 in contact with a lower surface of the toilet bowl 54. The pin 18 (see FIG. 1) contacts the stop ends 50 (see FIG. 2) to prevent the traveler 24 from moving longitudinally off of the base 12. With the upper surface of the pad 31 positioned in contact with the toilet bowl 54, the pin 42 is then reinserted through one of the openings 40 and into one of the holes 30 aligned with the openings. The pin 42 secures the traveler 24 to the base 14 and restricts longitudinal movement of the traveler. The resilient pad 31 in bearing contact with the lower surface of the toilet bowl 54 communicates loading through the traveler 24 and the base 12 to the floor. In the embodiment in which the traveler 24 includes a transverse angled orientation, the pad 31 leans laterally towards the toilet bowl.

The spacings of the openings 30, 30*a*, 30*b*, and 30*c* facilitate positioning the traveler 24 such that one of the openings 40 aligns with one of the openings 30, 30*a*, 30*b*, or 30*c*, for selective receiving of the pin 42 to hold the traveler 24 fixed to the base 12.

In an alternate embodiment, a jack screw attached to supports in the base and the traveler enable the traveler to move longitudinally relative to the base.

Accordingly, the present invention provides a support device 10 readily and conveniently used for providing additional loading support to toilet bowls, and particularly cantilever mounted toilet bowls, for use by bariatric patients. Thus, a hospital with toilets lacking suitable supports for a bariatric patient can readily and conveniently install the support 10 in a hospital room occupied by such patient on short notice and remove this support upon departure of the patient.

The present invention accordingly provides a device for supporting cantilever toilets conveniently and readily, without the need to remove and reinstall the cantilever toilet, to meet timely the need for supporting such device with significantly less labor, time, and coordination. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A support for being disposed between a floor surface and a lower surface of distal end of a cantilever toilet bowl attached at one end to a wall and extending therefrom, comprising:

a base defining a surface disposed at an oblique angle relative to horizontal;

a guide rail attached to an upper portion of the base member substantially parallel to the upper surface;

a traveler operatively engaged to the guide member and movable on the upper surface for positioning at a selected position to bear against a lower surface of a cantilever toilet bowl.

2. The support as recited in claim 1, further comprising a resilient member attached to an upper surface of the traveler for cushioning the bearing contact with the lower surface of the toilet bowl.

3. The support as recited in claim 1, further comprising a pin projecting from the upper surface intermediate opposing longitudinal distal ends; and the traveler defining an elongate slot in a lower surface extending parallel to a longitudinal axis, whereby opposing surfaces of the traveler defining the distal extents of the slot define stops for the selective positioning of the traveler relative to the base.

4. The support as recited in claim 1, wherein the guide rail defines a plurality of spaced-part openings along an extent thereof; and the traveler defines at least one opening; and further comprising a pin selectively engaged in one of the openings in the guide rail aligned with the opening in the traveler for locking the traveler in the selected position.

5. The support as recited in claim 4, wherein the traveler defines four spaced-apart openings.

6. The support as recited in claim 5, wherein the openings are spaced apart non-uniformly.

7. The support as recited in claim 6, wherein a first and a second ones of the openings are spaced one and one-half inch apart, the second and a third ones of the openings are spaced one and one-fourths inch apart, and the third and a fourth ones of the openings are spaced three-fourths inch apart; and the openings in the guide rail are spaced on one-inch centers, thereby providing selective quarter-inch positioning of the traveler relative to the base.

8. The support as recited in claim 1, wherein the traveler defines a slot in a side portion; and the guide rail comprises an elongate member having a leg received in the slot, whereby the traveler moves relative to the base guided by the leg in the slot.

9. A support for being disposed between a floor surface and a lower surface of distal end of a cantilever toilet bowl attached at one end to a wall and extending therefrom, comprising:

a base defining a travel surface oriented at an oblique angle relative to a horizontal plane;

a traveler movable on the travel surface for selective positioning to contact a bearing surface thereof against a lower surface of a cantilever toilet bowl, the movement of the traveler on the travel surface moving the bearing surface relative to the base;

a guider associated with the travel surface for guiding the movement of the traveler on the travel surface relative to the base; and a holding member to secure the traveler in the selected position.

10. The support as recited in claim 9, further comprising a resilient member attached to an upper surface of the traveler for cushioning the bearing contact with the lower surface of the toilet bowl.

11. The support as recited in claim 10, further comprising a pin projecting from the upper surface intermediate opposing longitudinal distal ends; and the traveler defining an elongate slot in a lower surface extending parallel to a longitudinal axis, whereby opposing surfaces of the traveler defining the distal extents of the slot define stops for the selective positioning of the traveler relative to the base.

12. The support as recited in claim 11, wherein the guider defines a plurality of spaced-part openings along an extent thereof; and the traveler defines at least one opening; and the holding member comprising a pin selectively engaged in one of the openings in the guider aligned with the opening in the traveler for locking the traveler in the selected position.

13. The support as recited in claim 12, wherein the traveler defines four spaced-apart openings.

14. The support as recited in claim 13, wherein the openings are spaced apart non-uniformly.

15. The support as recited in claim 14, wherein a first and a second ones of the openings are spaced one and one-half inch apart, the second and a third ones of the openings are spaced one and one-fourths inch apart, and the third and a fourth ones of the openings are spaced three-fourths inch apart; and the openings in the guide rail are spaced on one-inch centers, thereby providing selective quarter-inch positioning of the traveler relative to the base.

16. The support as recited in claim 9, wherein the traveler defines a slot in a side portion; and the guider comprises an elongate member having a leg received in the slot, whereby the traveler moves relative to the base guided by the leg in the slot.

17. A method for supporting a distal end of a cantilever toilet bowl attached at one end to a wall and extending therefrom, comprising the steps of:

(a) placing a base under a distal end of a cantilever toilet bowl, the base defining a surface oriented at an oblique angle relative to a horizontal plane and having a guide rail attached to an upper portion of the base substantially parallel to the upper surface;

(b) moving a traveler operatively engaged to the guide member on the surface to a position such that a contact surface of the traveler bears against a lower surface of the cantilever toilet bowl; and (c) fixing the traveler in the selected position.

18. A support for being disposed between a floor surface and a lower surface of distal end of a cantilever toilet bowl attached at one end to a wall and extending therefrom, comprising:

a base defining a travel surface oriented at an oblique angle relative to a horizontal plane;

a traveler positioned on the travel surface and movable relative to the base for selective positioning to contact a bearing surface thereof against a lower surface of a cantilever toilet bowl; and a holder to secure the traveler in the selected position.

19. The support as recited in claim 18, wherein the holder comprises:

a guide rail associated with the travel surface for guiding the movement of the traveler on the travel surface relative to the base, the guide rail defining a plurality of spaced-part openings along an extent thereof; and the traveler further defines at least one opening; and a pin for extending selectively through one of the openings in the guide rail aligned with the opening in the traveler for securing the traveler in the selected position.

20. The support as recited in claim 19, wherein the traveler defines four spaced-apart openings and in which a first and a second ones of the openings in the traveler are spaced a first distance apart, the second and a third ones of the openings in the traveler are spaced a second distance apart, the second distance less than the first distance by a factor, and the third and a fourth ones of the openings in the traveler are spaced a third distance apart, the third distance less than the first distance by three times the factor; and the openings in the guide rail are spaced on centers of a fourth distance, the fourth distance less than the first distance apart by twice the factor, thereby providing selective factor-incremented positioning of the traveler relative to the base.

* * * * *